US005821739A

United States Patent [19]

Imoto

[11] Patent Number: 5,821,739

[45] Date of Patent: Oct. 13, 1998

[54] ELECTRIC ADJUSTER

[76] Inventor: Nariisa Imoto, 4-18, Abiko 5-chome, Sumiyoshi-ku, Osaka-shi, Osaka 558, Japan

[21] Appl. No.: 737,601

[22] PCT Filed: May 24, 1995

[86] PCT No.: PCT/JP95/00992

§ 371 Date: Nov. 25, 1996

§ 102(e) Date: Nov. 25, 1996

[87] PCT Pub. No.: WO95/33270

PCT Pub. Date: Dec. 7, 1995

[30] Foreign Application Priority Data

May 27, 1994 [JP] Japan ..... 6-150690

[51] Int. Cl.[6] ..... G05F 1/16

[52] U.S. Cl. ..... 323/258; 323/255

[58] Field of Search ..... 323/255, 258

[56] References Cited

U.S. PATENT DOCUMENTS

| | | | |
|---|---|---|---|
| 1,430,987 | 10/1922 | Hanff | 373/104 |
| 3,603,971 | 9/1971 | Woschetzky et al. | 323/255 |
| 3,978,395 | 8/1976 | Legnaioli | 323/255 |
| 4,220,911 | 9/1980 | Rosa | 323/258 |
| 4,348,590 | 9/1982 | Daniels et al. | 378/112 |
| 4,454,466 | 6/1984 | Ritter | 323/258 |
| 4,748,341 | 5/1988 | Gupta | 323/258 |
| 5,602,462 | 2/1997 | Stich et al. | 323/258 |

*Primary Examiner*—Stuart N. Hecker

*Attorney, Agent, or Firm*—Armstrong, Westerman, Hattori, McLeland, & Naughton

[57] ABSTRACT

An electric adjuster is so designed that, in order that an a.c. power supply or an a.c. signal as an input is arbitrarily adjusted or converted with high efficiency and outputted, the ratio of winding of a transformer can be arbitrarily adjusted or continuously adjusted. Thus the output voltage is automatically adjusted to become constant.

3 Claims, 2 Drawing Sheets

ELECTRIC ADJUSTER

BACKGROUND OF THE INVENTION

1. Field of the Invention

The present invention relates to voltage or current adjusting means which is indispensable to an electric control unit such as a stabilized power supply unit, an electric motor control unit, a power control unit or a variety of power supply units. The present invention also relates to a static type voltage or current adjuster (hereinafter referred to as "electric adjuster") of a novel system which is high in efficiency, high in response speed, small in size, light in weight, limitless in load power factor, and relatively simple to make the accuracy high without generating a power-supply harmonic current.

2. Description of the Related Art

Nowadays, as a result of miniaturizing of electronic components and a high integration, electronic equipments are realized to be made small in size, light in weight, low in costs and high in efficiency with an enhancement of their function and accuracy year by year. In case of the above electric control unit or the like, because of the characteristics inherent to a power converter, the like progress with other electronic equipments is difficult. Basically, since the electric control unit takes over old technique as it is, and also, in a thyristor phase control system or a switching system, electromagnetic interference in other electronic equipments which are caused during switching operation or a harmonic current which is generated during the switching operation adversely affects an electric power system of an electric power company. For the above and other reasons, the great progress of the conventional technique could not be expected.

As the control systems for the conventional electric adjuster, the CVT system, the sliding system, the magnetic amplifier system, the tap switching system, the thyristor phase control system and the switching system are mainly employed. The main performances required for the electric adjuster of the electric control unit include high efficiency, a high-speed response, a small size with light weight, no power-supply higher harmonics, no limitation of load power factor, simple to obtain a high precision, a high reliability, low costs, a static type, and so on.

In case of the sliding system, since it is not of the static type but has a movable portion, the frequent repairing is required, and the reliability is low. Also, there are limitations of making the efficiency high, the response speed high, the size small, the weight light and the precision high. In case of the CVT system and the magnetic amplifier system, because they are of the static type, although the reliability is high, it is very heavy in weight, and therefore, there are limitations of making the efficiency high, the response speed high, the size small with light weight and the precision high. In case of the tap switching system, a switching period is long, and the control resolution is low. In addition, there are limitations of making the efficiency high, the size small and the weight light. In case of the thyristor phase control system and the switching system, there arise problems such as electromagnetic interferences caused by the distortion of an output voltage waveform or the generation of switching noises, and a harmonic current, and also such a problem that it cannot be used for a load low in power factor. Moreover, there also have limitations of making the efficiency high, the response speed high, and the size small with light weight and the precision high.

SUMMARY OF THE INVENTION

The present invention has been made to eliminate the problems with the conventional electric adjusters, and therefore an object of the present invention is to provide a novel electric adjuster in place of the control systems such as the CVT system employed in the conventional electric adjusters, the sliding system, the magnetic amplifier system, the tap switching system, the thyristor phase control system and the switching system.

Another object of the present invention is to provide a static type electric adjuster which is improved with the results of a high efficiency, a high-speed response, a small size, a light weight, no power-supply higher harmonic, no limitation of a load power factor, the simplification of making the accuracy high, a high reliability and low costs, which are performances required for the electric adjuster for an electric control unit.

In case of converting an a.c. voltage from a certain value to another value, there is well known that it is best to use a transformer. The ratio of transformation is determined in accordance with the turn ratio of the transformer. According to the present invention, for the purpose of making a voltage variable with a high performance, a plurality of windings are disposed on a primary side, a secondary side or both of the primary and secondary sides of the transformer, and the connection of the windings is switched with an arbitrary combination of connection such as a series connection or a parallel connection, thereby being capable of continuously varying the ratio of composite winding between the primary side and the secondary side.

When a plurality of windings are combined by a series connection through a binary system which is well known in the digital field, the number of combinations is $2^n$ (n is the number of windings) with the result that the ratio of winding can be adjusted over a wider range with the reduced number of windings. For example, 16 kinds of combinations are enabled with 4 windings, 256 kinds of combinations are enabled with 8 windings, and 1024 kinds of combinations are enabled with 10 windings.

When the digital transformer thus constituted with the variable number of windings is used as a series transformer for the voltage adjuster of a series transformer system, a voltage adjuster with a higher performance can be provided, and very flexible control can be performed by controlling the ratio of windings through a microcomputer.

The above and other objects and features of the present invention will be more apparent from the following description taken in conjunction with the accompanying drawings.

DETAILED DESCRIPTION OF THE PREFERRED EMBODIMENTS

Now, a description will be given in more detail of preferred embodiments of the present invention with reference to the accompanying drawings.

Figure 1:
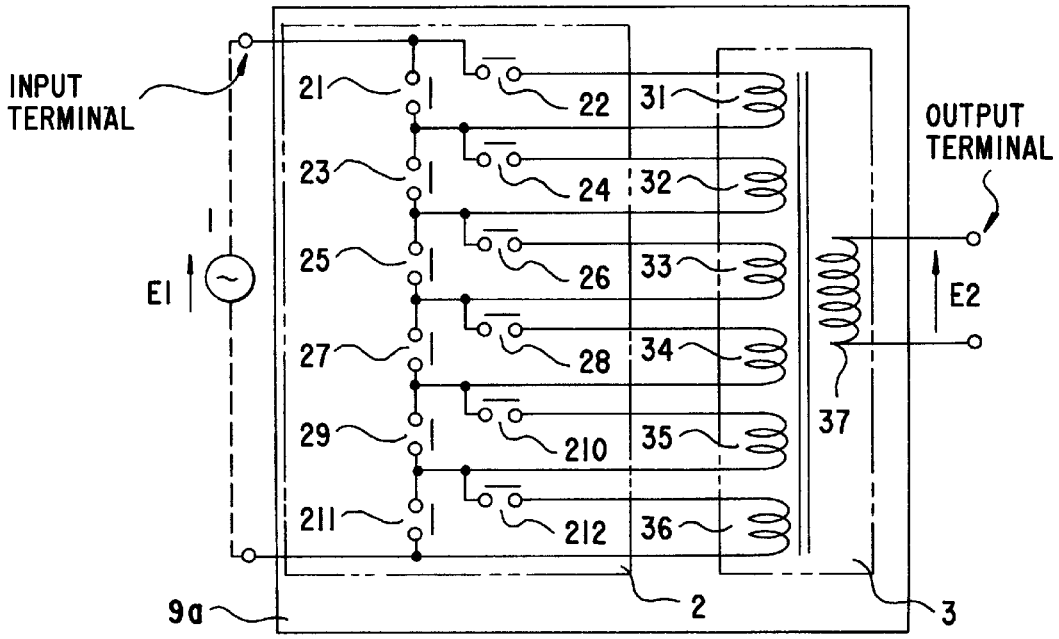
FIG. 1 is a block diagram showing a main electric circuit of an electric adjuster in accordance with one embodiment of the present invention.

FIG. 1 is a block diagram showing a main electric circuit of an electric adjuster with 6 primary windings in accordance with one embodiment of the present invention. As shown in FIG. 1, the main electric circuit includes an a.c. power supply 1 providing a primary-side input voltage; a transformer 3 having a secondary winding 37 and a plurality of primary windings 31, 32, 33, 34, 35 and 36 whose ratios of windings to the secondary winding 37 are 1, 2, 4, 8, 16 and 32, respectively; and a winding switching operation section 2 that switches the combinations of the plural primary windings 31 to 36 by a plurality of switches 21, 22, 23, 24, 25, 26, 27, 28, 29, 210, 211 and 212, to make the number of composite winding variable, with the result that the ratio of winding to the secondary winding is digitally continuously adjusted.

Since the ratio of winding (a1) to the secondary winding can be digitally continuously varied from 1 to 63 with the operation of the winding switching operation section 2, an output voltage E2 is expressed by E1/a1 where E1 is an input voltage, thus being capable of adjusting a voltage. Even though the ratios of windings of the primary windings 31 to 36 to the secondary winding 37 are not 1, 2, 4, 8, 16 and 32, respectively, they can be determined arbitrarily in accordance with a purpose. Likewise, the number of the primary windings can be arbitrarily determined in accordance with the purpose if it is two or more. Further, a tap may be disposed on each of the primary windings or the secondary winding so as to provide a more complicated adjusting function. Alternatively, a plurality of independent transformers may be provided instead of the transformer 3 so as to be connected in the same manner as the above to obtain the equivalent function.

Figure 2:
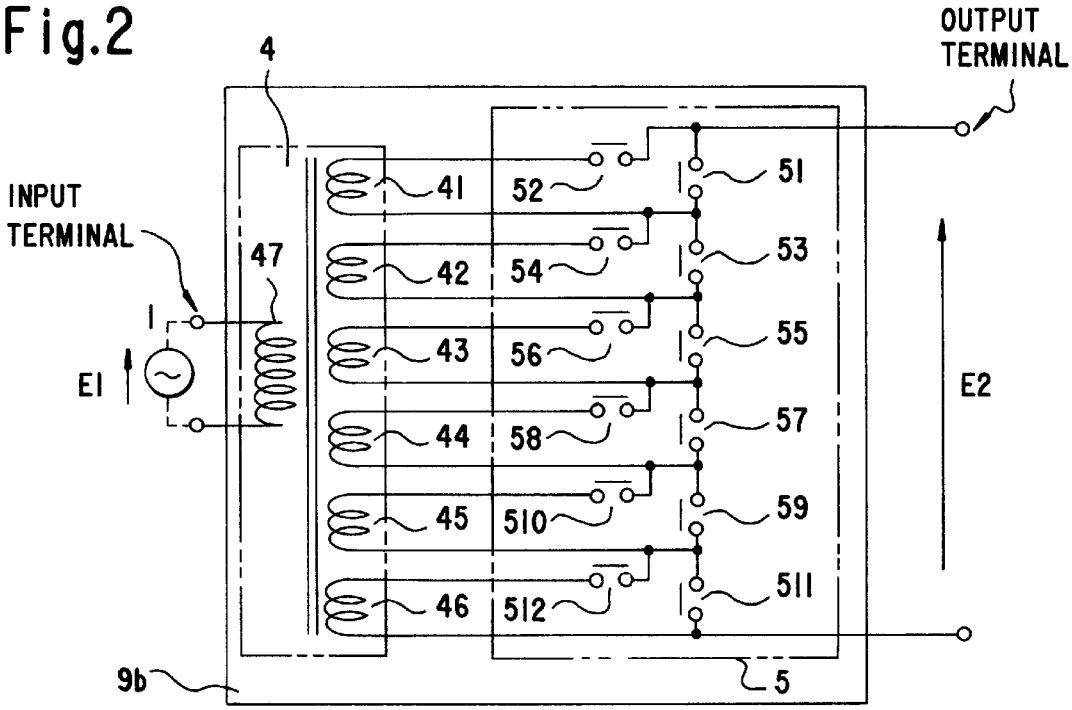
FIG. 2 is a block diagram showing a main electric circuit of an electric adjuster in accordance with another embodiment of the present invention.

FIG. 2 is a block diagram showing a main electric circuit of an electric adjuster with 6 secondary windings in accordance with one embodiment of the present invention. As shown in FIG. 2, the main electric circuit includes an a.c. power supply 1 providing a primary-side input voltage; a transformer 4 having a primary winding 47 and a plurality of primary windings 41, 42, 43, 44, 45 and 46 whose ratios of windings to the primary winding 47 are 0.01, 0.02, 0.04, 0.08, 0.16 and 0.32, respectively; and a winding switching operation section 5 that switches the combinations of the plural secondary windings 41 to 46 by a plurality of switches 51, 52, 53, 54, 55, 56, 57, 58, 59, 510, 511 and 512, to make the number of composite winding variable, with the result that the ratio of winding to the primary winding is digitally continuously adjusted.

Since the ratio of winding (a2) to the primary winding can be digitally continuously varied from 0.1 to 0.63 with the operation of the winding switching operation section 5, an output voltage E2 is expressed by E1×a2 where E1 is an input voltage, thus being capable of adjusting a voltage with the resolution of E1×0.01. Even though the ratios of windings of the secondary windings 41 to 46 to the primary winding 47 are not 0.01, 0.02, 0.04, 0.08, 0.16 and 0.32, respectively, they can be determined arbitrarily in accordance with a purpose. Likewise, the number of the secondary windings can be arbitrarily determined in accordance with the purpose if it is two or more. Further, a tap may be disposed on each of the secondary windings or the primary winding so as to provide a more complicated adjusting function. Alternatively, a plurality of independent transformers may be provided instead of the transformer 4 so as to be connected in the same manner as the above to obtain the equivalent function.

Figure 3:
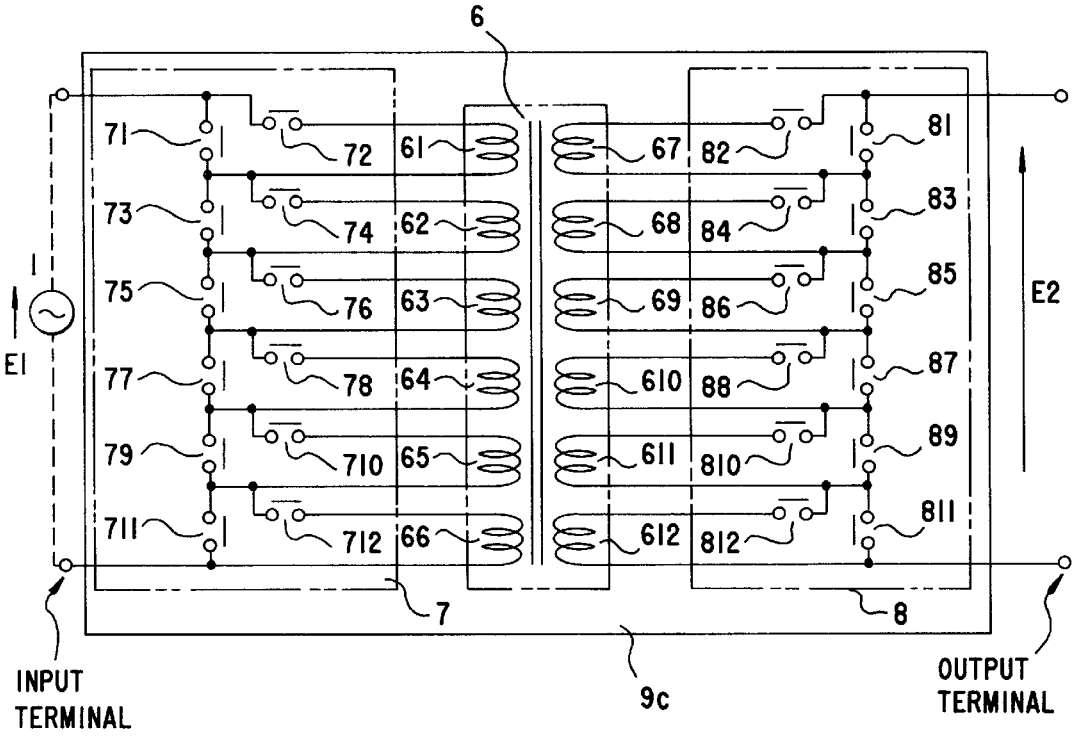
FIG. 3 is a block diagram showing a main electric circuit of an electric adjuster in accordance with still another embodiment of the present invention.

FIG. 3 is a block diagram showing a main electric circuit of an electric adjuster with 6 primary windings and 6 secondary windings in accordance with still another embodiment of the present invention. As shown in FIG. 3, the main electric circuit includes an a.c. power supply 1 providing a primary-side input voltage; a transformer 6 having primary windings 61, 62, 63, 64, 65 and 66 whose ratios of windings to a secondary winding 67 with the smallest number of winding are 1, 2, 4, 8, 16 and 32, respectively, and secondary windings 67, 68, 69, 610, 611 and 612 whose ratios of windings to the primary winding 61 with the smallest number of winding are 0.01, 0.02, 0.04, 0.08, 0.16 and 0.32, respectively; a winding switching operation section 7 that switches the combinations of the plural primary windings 61 to 66 by a plurality of switches 71, 72, 73, 74, 75, 76, 77, 78, 79, 710, 711 and 712, to make the number of composite winding variable, with the result that the ratio of winding to the secondary windings are digitally continuously adjusted; and a winding switching operation section 8 that switches the combinations of the plural secondary windings 67 to 69, 610, 611 and 612 by a plurality of switches 81, 82, 83, 84, 85, 86, 87, 88, 89, 810, 811 and 812, to make the number of composite winding variable, with the result that the ratio of winding to the primary windings are digitally continuously adjusted.

Since the ratio of winding (a1) to the secondary winding can be digitally continuously varied from 1 to 63 with the operation of the winding switching operation section 7, and also the ratio of winding (a2) to the primary winding can be digitally continuously varied from 0.01 to 0.63 with the operation of the winding switching operation section 8, an output voltage E2 is expressed by E1×a2/a1 where E1 is an input voltage, thus being capable of adjusting a voltage over a relatively wide range or relatively finely. The combinations of the ratios of windings of the primary windings as well as the secondary windings primary winding 47 can be arbitrarily determined in accordance with a purpose. Likewise, the number of the primary and secondary windings can be arbitrarily determined in accordance with the purpose, respectively, if they are two or more. Further, a tap may be disposed on each of the primary and secondary windings so as to provide a more complicated adjusting function. Alternatively, a plurality of independent transformers may be provided instead of the transformer 6 so as to be connected in the same manner as the above to obtain the equivalent function.

In any embodiments, the electric adjuster can be formed into a constant-voltage adjuster if the winding switching operation section is automatically operated by monitoring an output voltage. Similarly, the electric adjuster can be formed into a constant-current adjuster if the winding switching operation section is automatically operated by monitoring an output current.

In addition, the primary-side input voltage E1 may be a variety of a.c. voltage/current signals such as a sensor signal, a detection signal or a control signal instead of an a.c. power supply, and in this case, it is effective as a signal converter.

As was described above, the electric adjuster of the present invention is applied to a stabilized power supply unit, an electric motor control unit, a power control unit, and a variety of power supply units, and so on, thereby enabling great improvements such as making the efficiency high, the response speed high, the size small with light weight, no power-supply higher harmonic, no limitation of a load power factor, and making the precision high, the reliability high, and the costs low, thus providing economical effects from a variety of viewpoints in the industrial field.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An electric adjuster, comprising:

a transformer having one secondary winding and a plurality of primary windings the numbers of windings of which are twice, four times, eight times, . . . $2^{n-1}$ times as much as the smallest number of winding ( n is the number of the primary windings), respectively, said secondary winding having an output terminal providing an output voltage; and winding switching operation means for automatically switching the combinations of connections of the respective primary windings to adjust the number of composite primary windings in response to the output voltage provided by said output terminal to adjust the output voltage to become constant.

2. An electric adjuster, comprising:

a transformer having one primary and a plurality of secondary windings the numbers of windings of which are twice, four times, eight times, . . . $2^{m-1}$ times as much as the smallest number of winding (m is the number of the secondary windings), respectively said secondary winding having an output terminal providing an output voltage; and winding switching operation means for automatically switching the combinations of connections of the respective secondary windings to adjust the number of composite secondary windings in response to the output voltage provided by said output terminal to adjust the output voltage to become constant.

3. An electric adjuster, comprising:

a transformer having a plurality of primary windings the numbers of windings of which are twice, four times, eight times, . . . $2^{n-1}$ times as much as the smallest number of winding (n is the number of the primary windings), respectively, and a plurality of secondary windings the numbers of windings of which are twice, four times, eight times, . . . $2^{m-1}$ times as much as the smallest number of windings (m is the number of the secondary windings), respectively, said secondary winding having an output terminal providing an output voltage; and winding switching operation means for automatically switching the combinations of connections of the respective primary windings and the respective secondary windings to adjust the number of composite primary and secondary windings, respectively, in response to the output voltage provided by said output terminal to adjust the output voltage to become constant.

* * * * *